US010323400B2

(12) United States Patent
Hashimoto et al.

(10) Patent No.: US 10,323,400 B2
(45) Date of Patent: Jun. 18, 2019

(54) WASH-OUT TYPE TOILET

(71) Applicant: TOTO LTD., Kitakyushu-shi, Fukuoka (JP)

(72) Inventors: Hiroshi Hashimoto, Fukuoka (JP); Shinichi Urata, Fukuoka (JP); Shuichi Nagashima, Fukuoka (JP); Mayu Okubo, Fukuoka (JP); Shoko Imaizumi, Fukuoka (JP); Daisuke Yamamoto, Fukuoka (JP); Kenichi Nakamura, Fukuoka (JP); Takumi Tsuchitani, Fukuoka (JP)

(73) Assignee: TOTO LTD., Kitakyushu-shi (JP)

( * ) Notice: Subject to any disclaimer, the term of this patent is extended or adjusted under 35 U.S.C. 154(b) by 0 days.

(21) Appl. No.: 15/865,369

(22) Filed: Jan. 9, 2018

(65) Prior Publication Data

US 2018/0195262 A1 Jul. 12, 2018

(30) Foreign Application Priority Data

Jan. 12, 2017 (JP) ..... 2017-003572

(51) Int. Cl.
*E03D 11/02* (2006.01)
*E03D 11/08* (2006.01)
*E03D 11/18* (2006.01)

(52) U.S. Cl.
CPC ..... *E03D 11/18* (2013.01); *E03D 11/02* (2013.01); *E03D 11/08* (2013.01)

(58) Field of Classification Search
CPC ..... E03D 11/18; E03D 11/02; E03D 11/08
USPC ..... 4/421
See application file for complete search history.

(56) References Cited

U.S. PATENT DOCUMENTS 4,987,616 A * 1/1991 Ament ..... E03D 11/08 4/421
6,145,138 A * 11/2000 Nakamura ..... E03D 11/02 4/420

* cited by examiner

*Primary Examiner* — Tuan N Nguyen
(74) *Attorney, Agent, or Firm* — Amin, Turocy & Watson LLP

(57) ABSTRACT

A wash-out type toilet according to an embodiment includes a bowl that receives waste and a drainage water trap. The drainage water trap includes an inlet that is connected to a lower part of the bowl, a rise pipeline that is connected to the inlet and extends upward toward its own top part, a fall pipeline that extends downward toward an inlet of a drainage water pipe that is arranged on a floor surface, and an intermediate pipeline with an upstream-side portion that is connected to the rise pipeline and a downstream-side portion that is connected to the fall pipeline. Furthermore, the intermediate pipeline includes a retention surface that is formed to slope downward from an upstream side to a downstream side and temporarily retains waste at a time of toilet washing.

5 Claims, 8 Drawing Sheets

WASH-OUT TYPE TOILET

CROSS-REFERENCE TO RELATED APPLICATION(S)

This application is based upon and claims the benefit of priority of the prior Japanese Patent Application No. 2017-003572, filed on Jan. 12, 2017, the entire contents of which are incorporated by reference.

FIELD

An embodiment of the disclosure relates to a wash-out type toilet.

BACKGROUND

A so-called wash-out type toilet that washes away waste due to an action of running water that is provided by a drop of water has conventionally been known as one kind of flush toilet (see, for example, Japanese Laid-open Patent Publication No. 2016-176320). A waste discharge performance of a wash-out type toilet is determined by, for example, a water level difference of retained water in a bowl that is caused at a time of toilet washing.

That is, a waste discharge performance is determined depending on a water level difference between a water level of retained water before a start of washing and a highest water level of retained water at a time when washing water is supplied after the start of washing, and for example, such a discharge performance is improved with increasing such a water level difference.

However, water saving is desired for a flush toilet in recent years and an amount of washing water that is supplied to a bowl is reduced. As an amount of washing water is reduced, it may be impossible to ensure a water level difference as described above sufficiently and a discharge performance may be degraded. Thus, there is room for improvement in a wash-out type toilet according to a conventional technique in that a waste discharge performance thereof is improved.

SUMMARY

A wash-out type toilet according to an embodiment includes a bowl that receives waste and a drainage water trap. The drainage water trap includes an inlet that is connected to a lower part of the bowl, a rise pipeline that is connected to the inlet and extends upward toward its own top part, a fall pipeline that extends downward toward an inlet of a drainage water pipe that is arranged on a floor surface, and an intermediate pipeline with an upstream-side portion that is connected to the rise pipeline and a downstream-side portion that is connected to the fall pipeline. Furthermore, the intermediate pipeline includes a retention surface that is formed to slope downward from an upstream side to a downstream side and temporarily retains waste at a time of toilet washing.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENT

Hereinafter, an embodiment of a wash-out type toilet as disclosed in the present application will be described in detail with reference to the accompanying drawings. Additionally, this invention is not limited by an embodiment as described below.

1. Configuration of Wash-Out Type Toilet

Figure 1:
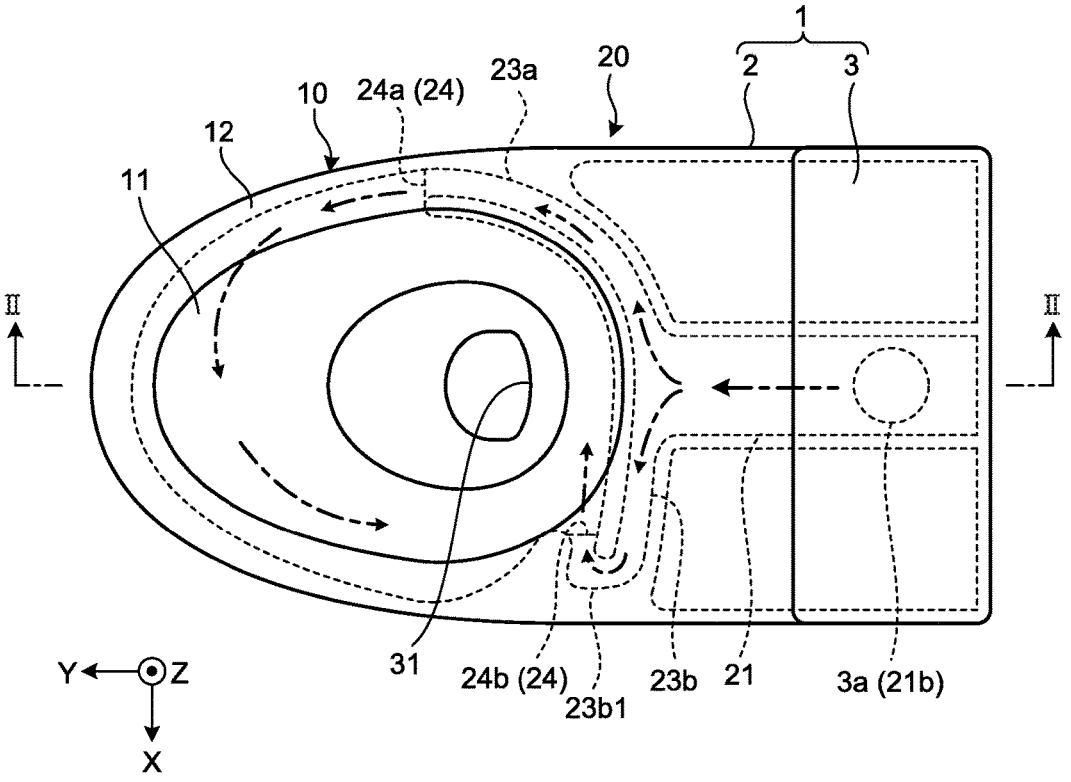
FIG. 1 is a plan view illustrating a wash-out type toilet according to an embodiment.
Figure 2:
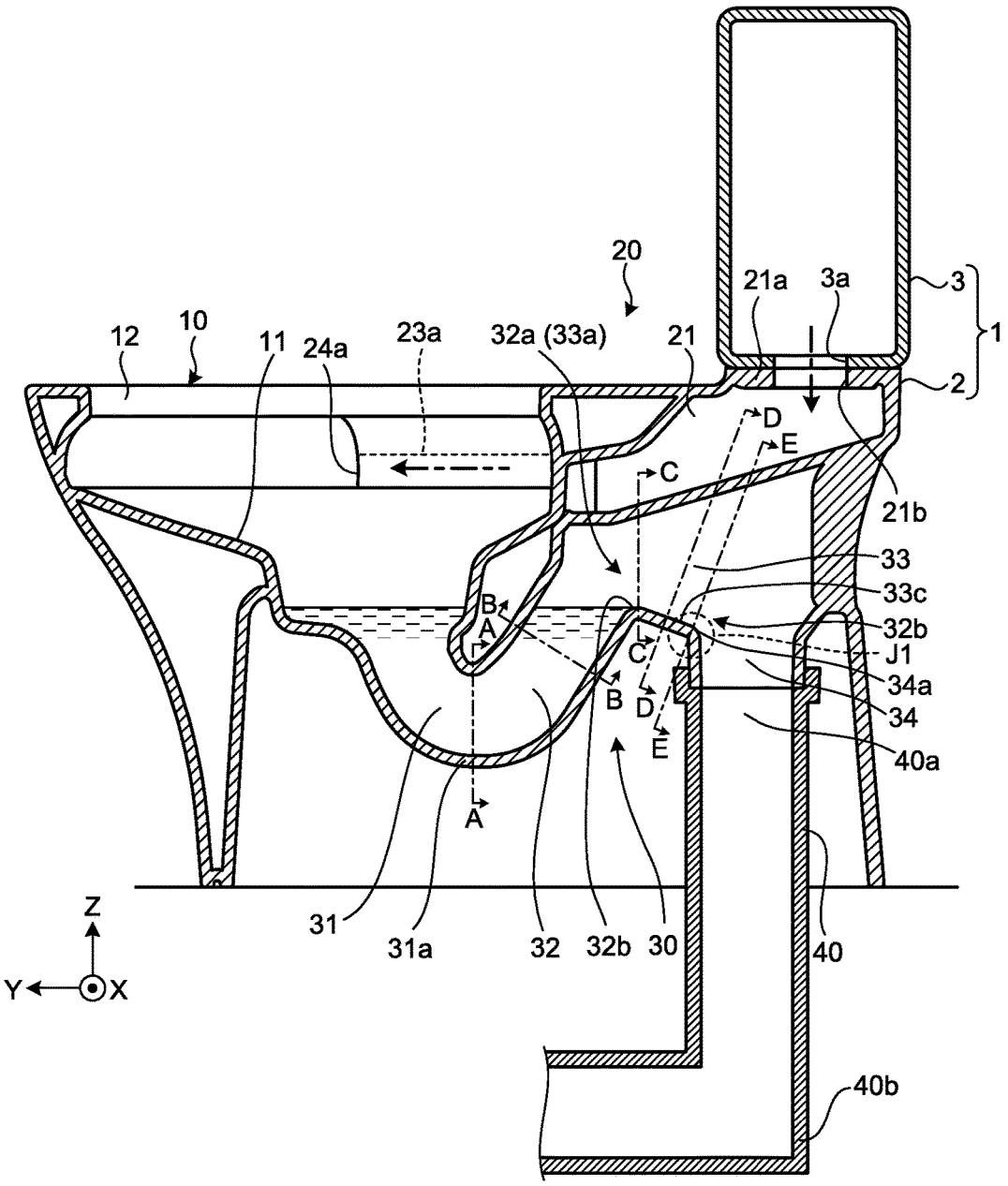
FIG. 2 is a cross-sectional view along line II-II of FIG. 1.

FIG. 1 is a plan view illustrating a wash-out type toilet according to an embodiment and FIG. 2 is a cross-sectional view along line II-II of FIG. 1. Additionally, FIG. 1 or the like illustrates a three-dimensional orthogonal coordinate system that includes a Z-axis with a vertically upward direction being a positive direction thereof, for readily understanding an explanation(s). Such an orthogonal coordinate system may also be illustrated in another diagram.

Furthermore, in the following description(s), a positive direction of an X-axis, a negative direction of the X-axis, a positive direction of a Y-axis, a negative direction of the Y-axis, a positive direction of a Z-axis, and a negative direction of the Z-axis in an orthogonal coordinate system may be described as a "rightward direction", a "leftward direction", a "forward direction", a "backward direction", an "upward direction", and a "downward direction", respectively. Additionally, any diagram that is provided subsequent to FIG. 1, FIG. 2, and FIGS. 3A to 3E is a schematic diagram.

As illustrated in FIG. 1 and FIG. 2, a wash-out type toilet 1 is a flush toilet that uses a washing method where waste is washed away due to an action of running water that is provided by a drop of washing water in a bowl 10. The wash-out type toilet 1 may be described as a "flush toilet 1" below. Furthermore, the flush toilet 1 is a floor-mounted type flush toilet.

The flush toilet 1 is made of, for example, a ceramic and includes a toilet body 2 and a water storage tank 3.

The water storage tank 3 is placed on a back and upper part of the toilet body 2. The water storage tank 3 stores washing water that washes the bowl 10 of the toilet body 2.

As illustrated in FIG. 2, an opening 3*a* that penetrates through a bottom surface of the water storage tank 3 in upward and downward directions is provided on the bottom surface. A non-illustrated on-off valve is installed at the opening 3*a*, and as a (non-illustrated) operation part for starting toilet washing is operated, opening is executed for the opening 3*a* to drain washing water. Additionally, although the water storage tank 3 is an example of a water supply source, this is not limiting and a flush valve may be used as a water supply source.

The toilet body 2 includes a bowl 10, a water guide channel 20, and a drainage water trap 30 (see FIG. 2). Additionally, FIG. 1 or 2 omits illustration of some members such as a toilet seat that is included in the toilet body 2 or a cover that covers such a toilet seat for simplification of illustration.

The bowl 10 includes a waste receiving surface 11 and a rim part 12. The waste receiving surface 11 is formed into a bowl shape capable of receiving waste. The rim part 12 is formed so as to compose an upper edge of the bowl 10.

The water guide channel 20 is a flow channel that guides washing water in the water storage tank 3 to the bowl 10. Specifically, the water guide channel 20 includes a main water guide channel 21, a first rim water guide channel 23*a*, a first water spout part 24*a*, a second rim water guide channel 23*b*, and a second water spout part 24*b*.

As illustrated in FIG. 2, the main water guide channel 21 is formed from a lower part of the water storage tank 3 toward a front part of a toilet and causes washing water that is supplied from the water storage tank 3 to flow thereon. Additionally, an arrow of a dashed-dotted line in the figure indicates a flow of washing water. In detail, an inflow port 21*b* that penetrates through a back part ceiling surface 21*a* of the main water guide channel 21 in upward and downward directions is formed on the back part ceiling surface 21*a* at a position that corresponds to the opening 3*a* of the water storage tank 3. The inflow port 21*b* causes washing water in the water storage tank 3 to flow into the main water guide channel 21 as opening is executed for the opening 3*a* by an on-off valve of the water storage tank 3 as described above.

As illustrated in FIG. 1, the main water guide channel 21 is branched into the first rim water guide channel 23*a* and the second rim water guide channel 23*b* on a downstream side. Therefore, washing water that is supplied to the main water guide channel 21 flows into the first rim water guide channel 23*a* and the second rim water guide channel 23*b*.

The first rim water guide channel 23*a* is formed along the rim part 12 from a back part to a left part of the bowl 10. The first water spout part 24*a* that is formed, for example, near a center of a left part of the rim part 12 is provided at an end part of the first rim water guide channel 23*a* on a downstream side.

Therefore, washing water that flows into the first rim water guide channel 23*a* from the main water guide channel 21 flows counterclockwise in a plan view, and subsequently, is spouted from the first water spout part 24*a* to the waste receiving surface 11 of the bowl 10.

The second rim water guide channel 23*b* is formed along the rim part 12 on a back part of the bowl 10. Furthermore, the second rim water guide channel 23*b* includes a bending site 23*b*1 that bends a flow direction of washing water in the middle of such a flow channel. Specifically, the bending site 23*b*1 of the second rim water guide channel 23*b* bends a flow direction of washing water that flows toward a front part of the bowl 10, more specifically, causes such washing water to make a U-turn and is directed to a back part of the bowl 10. The second water spout part 24*b* that is formed on, for example, a right and back part of the rim part 12 is provided on an end part of the second rim water guide channel 23*b* on a downstream side.

Therefore, washing water that flows into the second rim water guide channel 23*b* from the main water guide channel 21 flows clockwise in a plan view, and subsequently, a flow direction thereof is reversed by the bending site 23*b*1 to be counterclockwise. Subsequently, washing water is spouted counterclockwise from the second water spout part 24*b* to the waste receiving surface 11 of the bowl 10.

Thus, the flush toilet 1 according to the present embodiment spouts washing water from the first and second rim water guide channels 23*a* and 23*b* that are provided on the rim part 12, and generates a swirling flow on the waste receiving surface 11 of the bowl 10 to execute washing of the bowl 10.

As described above, washing water that is supplied to the bowl 10 is stored in the bowl 10 and the drainage water trap 30 after toilet washing. In the present specification, washing water that is retained in the bowl 10 and the drainage water trap 30 may be described as "retained water". Furthermore, the drainage water trap 30 or the like is filled with retained water, so that such retained water functions as seal water and prevents an odor or the like from a drainage water pipe 40 as described later from flowing back to a side of the bowl 10.

2. Configuration of Drainage Water Trap

As illustrated in FIG. 2, the drainage water trap 30 includes an inlet 31, a rise pipeline 32, an intermediate pipeline 33, and a fall pipeline 34. The inlet 31 is connected a lower part of the waste receiving surface 11 of the bowl 10 so as to be continuous therewith and causes washing water from the bowl 10 to flow into the drainage water trap 30. The rise pipeline 32 is connected to the inlet 31 and formed so as to extend obliquely upward from a downstream-side portion of the inlet 31 to a top part 32*a* thereof.

Figure 3A:
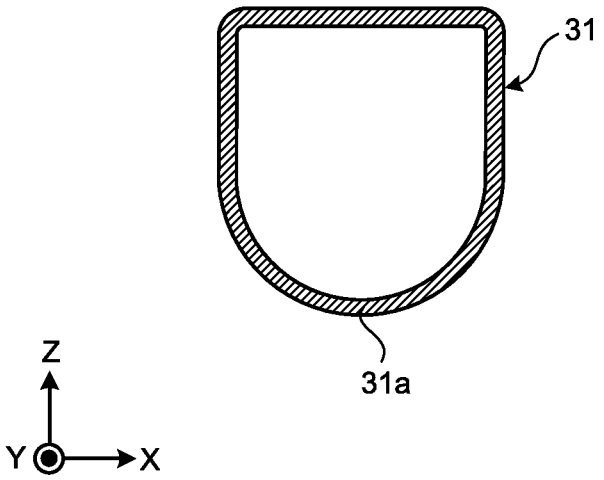
FIG. 3A is a cross-sectional view along line A-A of FIG. 2.
Figure 3B:
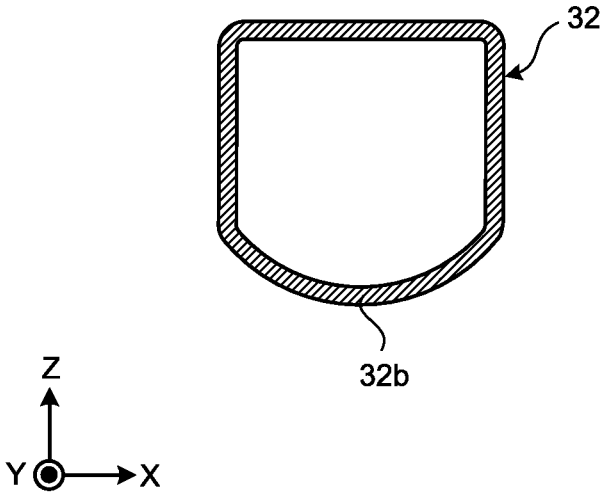
FIG. 3B is a cross-sectional view along line B-B of FIG. 2.
Figure 3C:
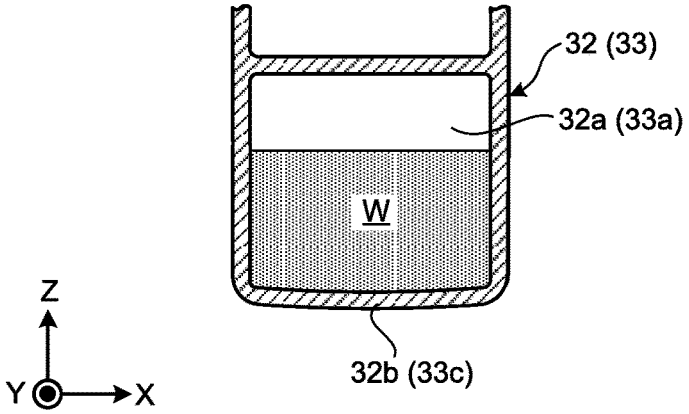
FIG. 3C is a cross-sectional view along line C-C of FIG. 2.

FIG. 3A is a cross-sectional view along line A-A of FIG. 2, FIG. 3B is a cross-sectional view along line B-B of FIG. 2, and FIG. 3C is a cross-sectional view along line C-C of FIG. 2. Additionally, FIG. 3A illustrates a cross-sectional shape of the inlet 31, FIG. 3B illustrates a cross-sectional shape of an intermediate part of the rise pipeline 32, and FIG. 3C illustrates a cross-sectional shape of the top part 32*a* that is a downstream-side portion of the rise pipeline 32. Additionally, although a term of "bottom surface" will be used below, a "bottom surface" in the present specification refers to a lower surface that connects a left side portion and a right side portion in a pipeline, or in other words, refers to a site that includes at least a lowermost surface of a pipeline where the surface is covered with washing water or the like, for example, when washing water, drainage water, or the like flows therein.

As illustrated in FIG. 3A, the inlet 31 is formed in such a manner that a bottom surface 31*a* thereof is comparatively greatly curved downward. Then, as illustrated in FIGS. 3B and 3C, the rise pipeline 32 is formed in such a manner that a bottom surface 32*b* thereof is gradually flattened toward a downstream side, that is, the rise pipeline 32 is formed in such a manner that a radius of curvature of the bottom surface 32*b* of the top part 32*a* is greater than a radius of curvature of the bottom surface 31*a* of the inlet 31.

Thereby, it is possible for waste to pass over the top part 32*a* of the rise pipeline 32 smoothly, together with washing water, at a time of toilet washing. That is, at a time of toilet washing, waste passes over the bottom surface 32*b* of the top part 32*a* and is discharged to a downstream side. For example, if a radius of curvature of the bottom surface 32*b* of the top part 32*a* is comparatively small like the bottom surface 31*a* of the inlet 31 as illustrated in FIG. 3A, in other words, if it is comparatively greatly curved downward, a shape thereof is provided in such a manner that a width in left and right directions is reduced toward a lower part thereof. Accordingly, waste is readily caught on a narrowed site and does not readily pass over the bottom surface 32*b*.

Hence, a radius of curvature of the bottom surface 32*b* of the top part 32*a* of the rise pipeline 32 according to the present embodiment is set as described above, so that it is possible to provide the bottom surface 32*b* with a comparatively flat shape as illustrated in FIG. 3C. Thereby, a site where a width thereof in left and right directions is reduced toward a lower part thereof is not formed on the top part 32*a* of the rise pipeline 32, so that waste is not readily caught, and hence, it is possible to pass over the bottom surface 32*b* smoothly. Additionally, "waste" in the present specification may be used to mean that a solid matter such as bodily waste or toilet paper is included therein.

By returning to a description(s) for FIG. 2, the intermediate pipeline 33 is arranged between the rise pipeline 32 and the fall pipeline 34 and couples the rise pipeline 32 with the fall pipeline 34. In detail, the intermediate pipeline 33 is provided in such a manner that an upstream-side portion 33*a* thereof is connected to the rise pipeline 32 while a downstream-side portion 33*b* thereof is connected to the fall pipeline 34.

The intermediate pipeline 33 includes a retention surface 33*c*. The retention surface 33*c* is a bottom surface of the intermediate pipeline 33, in detail, a surface that connects the bottom surface 32*b* of the top part 32*a* of the rise pipeline 32 and an upper end surface 34*a* of the fall pipeline 34. As described above, the retention surface 33*c* is a bottom surface of the intermediate pipeline 33 so that waste flows on the retention surface 33*c* at a time of toilet washing. Furthermore, as indicated by a closed curve J1 of a broken line in FIG. 2, a connection part between the retention surface 33*c* and the upper end surface 34*a* of the fall pipeline 34 is formed so as to be bent.

The retention surface 33*c* is formed so as to slope slightly downward from an upstream side to a downstream side and temporarily retains waste at a time of toilet washing. Therefore, a slope angle of the retention surface 33*c* is set at a value in such a manner that it is possible to retain waste temporarily. Thereby, in the present embodiment, it is possible to improve a waste discharge performance of the flush toilet 1 where this will be described later by using FIG. 4A to FIG. 4C.

Figure 3D:
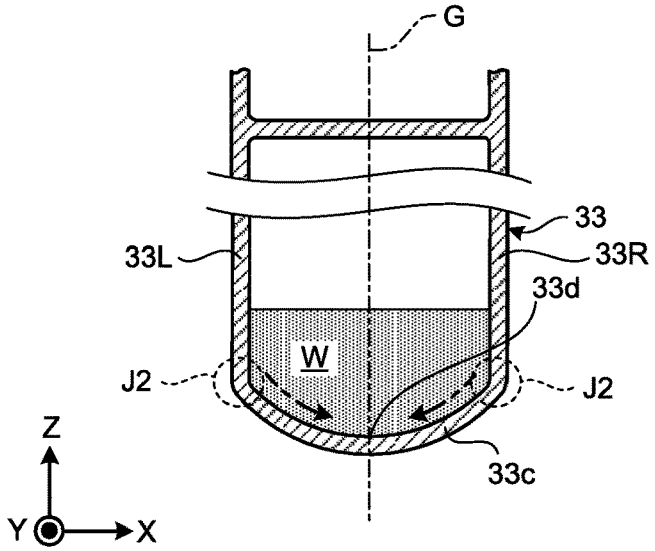
FIG. 3D is a cross-sectional view along line D-D of FIG. 2.
Figure 3E:
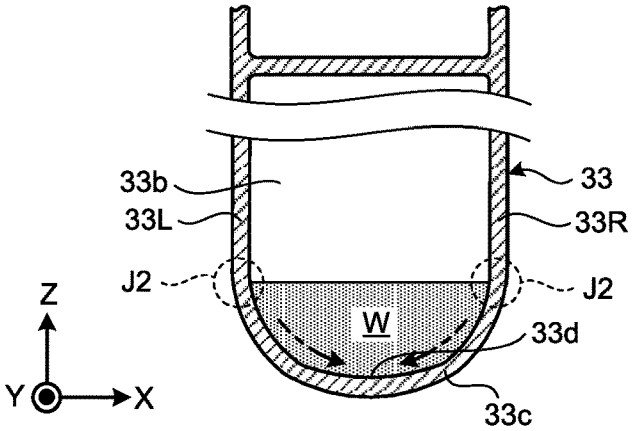
FIG. 3E is a cross-sectional view along line E-E of FIG. 2.

FIG. 3D is a cross-sectional view along line D-D of FIG. 2 and FIG. 3E is a cross-sectional view along line E-E of FIG. 2. Specifically, FIG. 3D illustrates a cross-sectional shape of an intermediate part of the intermediate pipeline 33 and FIG. 3E illustrates a cross-sectional shape of the downstream-side portion 33*b* of the intermediate pipeline 33. Additionally, a cross-sectional shape of the upstream-side portion 33*a* of the intermediate pipeline 33 is similar to a cross-sectional shape of the top part 32*a* of the rise pipeline 32, and hence, will be described by using FIG. 3C.

As illustrated in FIG. 3D and FIG. 3E, the retention surface 33*c* of the intermediate pipeline 33 includes a contraction flow part 33*d*. The contraction flow part 33*d* is a curved site that is dented downward. Furthermore, the contraction flow part 33*d* is formed at, for example, a center position of the retention surface 33*c* in a width direction thereof (a direction of an X-axis). Additionally, as illustrated in FIG. 3D, a center position is, for example, a position that includes a center line G of the intermediate pipeline 33 in a vertical direction in an X-Z plan view.

Therefore, in the intermediate pipeline 33, a flow of drainage water W that includes waste is contracted so as to be near a center line G by the contraction flow part 33*d* as indicated by an arrow of a dashed-dotted line. As drainage water W is contracted to decrease a flow passage area thereof, a flow rate thereof increases. Due to such an increase in a flow rate of drainage water W, it is possible to suppress occurrence of sealing in the drainage water pipe 40 as described later, where this will be described later by using 4D.

Furthermore, as illustrated in FIGS. 3D and 3E, a depth of the contraction flow part 33*d* in a direction of a vertical axis increases toward a downstream side so that drainage water W is further contracted. That is, the contraction flow part 33*d* contracts drainage water W from an upstream side to a downstream side, or in other words, is formed in such a manner that a flow passage area thereof is reduced from an upstream side to a downstream side. Thereby, it is possible to increase a flow rate of drainage water W efficiently and it is possible to suppress occurrence of sealing in the drainage water pipe 40 as described later effectively. Additionally, a flow passage area as described above means a cross-sectional area of drainage water W that flows through the contraction flow part 33*d*, per se, and is not necessarily identical to a cross-sectional area of the intermediate pipeline 33.

Furthermore, as indicated by a closed curve J2 of a broken line in FIGS. 3D and 3E, a connection part between a left side wall part 33L and the retention surface 33*c* and a connection part between a right side wall part 33R and the retention surface 33*c* in the intermediate pipeline 33 are formed in such a manner that radii of curvature thereof gradually increase toward a downstream side. Thereby, it is possible to increase a flow rate of drainage water W more efficiently.

Furthermore, a flow passage area of drainage water W on an upstream side of the contraction flow part 33*d* of the intermediate pipeline 33 is greater than that on a downstream side, so that a flow rate of drainage water W thereon is also less than that on a downstream side. Accordingly, waste that flows from the rise pipeline 32 is temporarily readily retained on the retention surface 33*c*. Additionally, although the contraction flow part 33*d* is formed all over an upstream side to a downstream side of a bottom surface of the intermediate pipeline 33 in the above description(s), this is not limiting and it may be formed on, for example, a part of the intermediate pipeline 33.

By returning to a description(s) for FIG. 2, the fall pipeline 34 is connected to a downstream side of the intermediate pipeline 33 so as to be continuous therewith. Furthermore, the fall pipeline 34 is formed so as to extend downward toward an inlet 40*a* of the drainage water pipe 40 that is arranged on a floor surface and connected to the drainage water pipe 40 through a non-illustrated drainage water socket or the like. Additionally, the drainage water pipe 40 includes a bending part 40*b* that extends downward by a predetermined length from an upper end part that is connected to the fall pipeline 34 and further bends a direction of drainage water toward a front part of the toilet body 2.

In a case where toile washing is executed in the drainage water trap 30 that is configured as described above, washing water in the bowl 10 is drained to the drainage water pipe 40 through the inlet 31, the rise pipeline 32, the intermediate pipeline 33, and the fall pipeline 34.

3. Flow of Drainage Water in Drainage Water Trap

Next, a flow of drainage water in the drainage water trap 30 at a time of toilet washing will be descried in detail with reference to FIG. 4A to FIG. 4D. FIG. 4A to FIG. 4D are illustration diagrams illustrating states of the drainage water trap 30 at a time of toilet washing in a time series. Additionally, waste is indicated by a sign of "F" in FIG. 4A or the like.

Figure 4A:
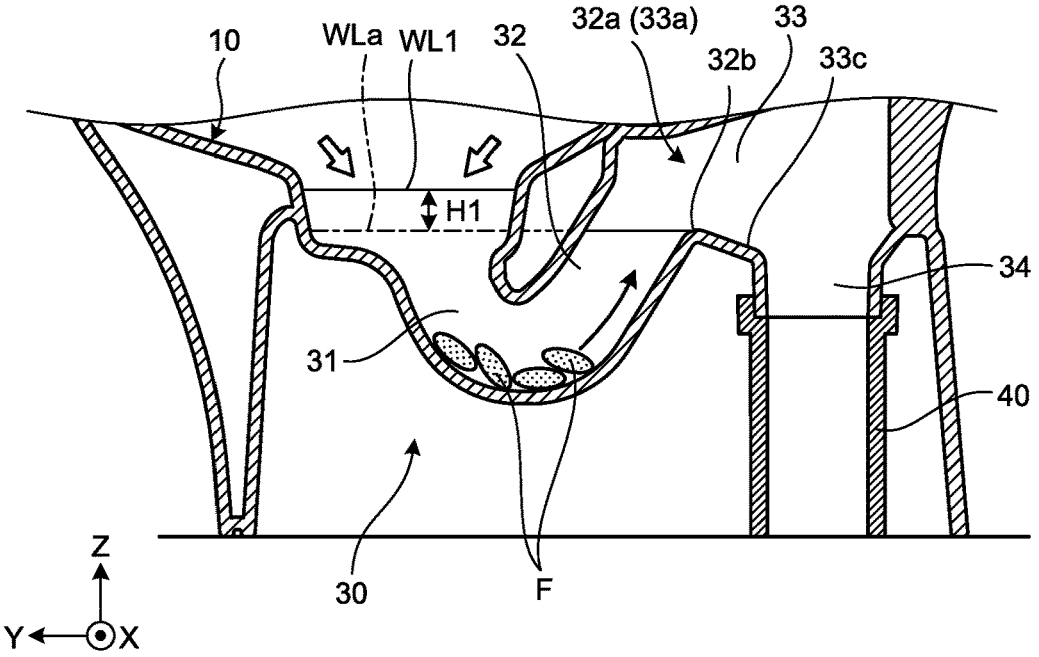
FIG. 4A is an illustration diagram illustrating a state of a drainage water trap at a time of toilet washing.

First, as illustrated in FIG. 4A, as toilet washing is started, washing water is supplied to the bowl 10 as indicated by a white arrow. A water level of retained water in the bowl 10 rises with such supply of washing water. In FIG. 4A, a water level after a start of supply of washing water is indicated by a sign of "WL1". Furthermore, a water level of retained water before a start of washing is identical to a height of the bottom surface 32*b* of the top part 32*a* of the rise pipeline 32 and is herein indicated as a lower limit water level WLa.

Therefore, a water level difference (head difference) H1 between a water level WL1 and a lower limit water level WLa is produced at a point of time as illustrated in FIG. 4A. Additionally, a flush toilet according to a conventional technique provides a waste discharge performance dependent on such a water level difference H1.

Figure 4B:
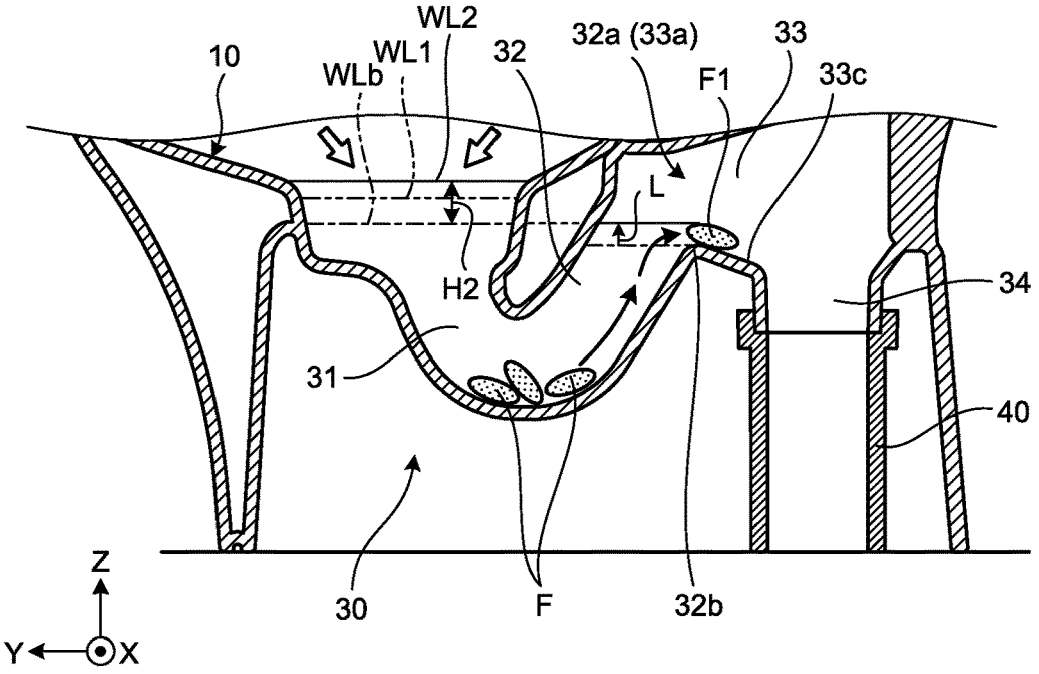
FIG. 4B is an illustration diagram illustrating a state of a drainage water trap at a time of toilet washing.

In the flush toilet 1 according to the present embodiment, the intermediate pipeline 33 includes the retention surface 33*c* so that waste F1 is temporarily retained on the retention surface 33*c* at a time of toilet washing as illustrated in FIG. 4B. Thereby, a lower limit water level in the drainage water trap 30 rises from a height of the bottom surface 32*b* of the top part 32*a* by a height L of waste F1. Herein, a risen lower limit water level is indicated by a sign of "WLb".

A water level WL2 of retained water in the bowl 10 also rises with rising of a lower limit water level WLb, as compared with a water level WL1 before retention of waste F1 as indicated by an imaginary line. Therefore, a water level difference H2 between a water level WL2 and a lower limit water level WLb is produced at a point of time as illustrated in FIG. 4B. Additionally, supply of washing water is continued even at a point of time in FIG. 4B.

Figure 4C:
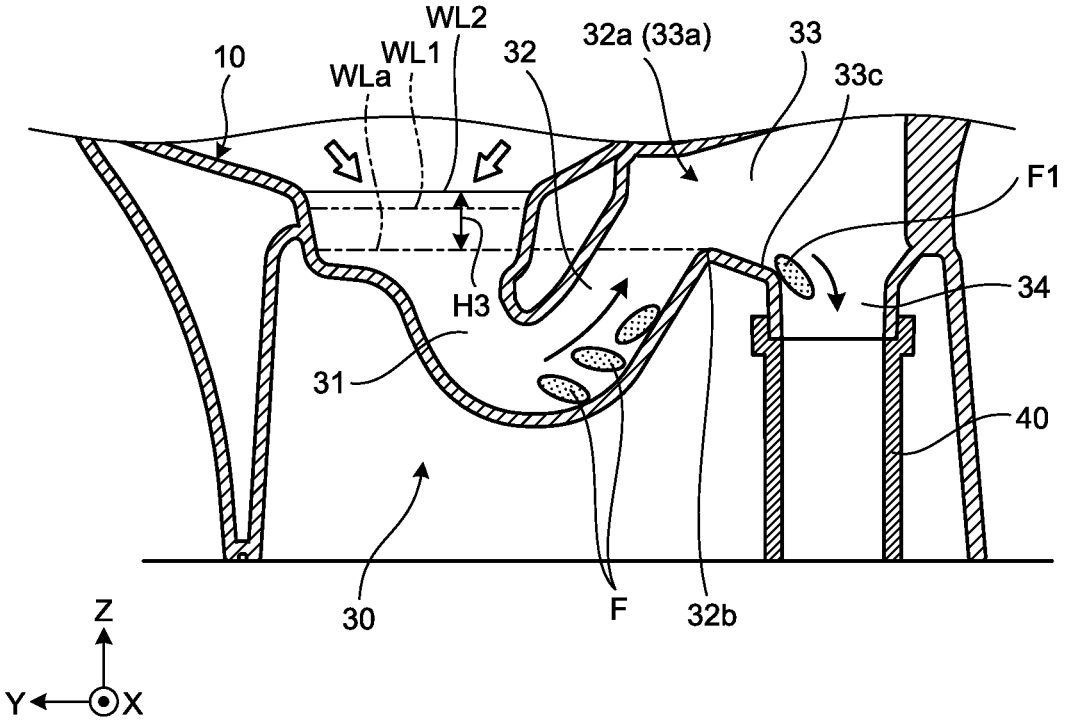
FIG. 4C is an illustration diagram illustrating a state of a drainage water trap at a time of toilet washing.

Then, as illustrated in FIG. 4C, waste F1 that is retained on the retention surface 33*c* is washed away toward the fall pipeline 34 on a downstream side by washing water. As waste F1 is washed away, a lower limit water level in the drainage water trap 30 returns to a height of the bottom surface 32*b* of the top part 32*a*, that is, returns to a lower limit water level WLa before such waste F1 is retained. Therefore, a water level difference H3 between a water level WL2 and a lower limit water level WLa is produced at a point of time as illustrated in FIG. 4C.

Thus, in the present embodiment, the retention surface 33*c* is included so that it is possible to raise a lower limit water level from a lower limit water level WLa to a lower limit water level WLb at a time of toilet washing to once raise a water level of retained water from a water level WL1 to a water level WL2 and subsequently drops (returns) such a lower limit water level from the lower limit water level WLb to the lower limit water level WLa.

Thereby, in the flush toilet 1, it is possible to ensure a water level difference H3 that is greater than a water level difference H1 as illustrated in FIG. 4A even for a comparatively small amount of washing water and it is possible to improve a discharge performance by an increase from the water level difference H1 to the water level difference H3. Additionally, in the flush toilet 1, a water level difference H3 is ensured to improve a discharge performance, so that it is also possible to reliably discharge, for example, waste F that remains in the rise pipeline 32 to the drainage water pipe 40 through the intermediate pipeline 33 and the fall pipeline 34.

Furthermore, the contraction flow part 33*d* is formed on the retention surface 33*c*, and thereby, it is possible to suppress occurrence of sealing in the drainage water pipe 40. As will be described in detail with reference to FIG. 4D, waste F that is temporarily retained on the retention surface 33*c* is pushed out toward the drainage water pipe 40 through the fall pipeline 34.

Herein, for example, if a flow rate of drainage water that includes waste F at a time when it is pushed out from the retention surface 33*c* is comparatively low, such drainage water that includes waste F drops straight down along an inner peripheral surface 40*c* of the drainage water pipe 40 on a side of the retention surface 33*c* as indicated by an imaginary line. Therefore, drainage water that includes waste F may flow through the drainage water pipe 40 so as to plug a flow channel thereof or accumulate in a state where it is localized to the bending part 40*b*, and in such a case, the bending part 40*b* may be sealed. As sealing occurs in the drainage water pipe 40, a negative pressure may be generated in the drainage water pipe 40 to cause a siphon phenomenon and seal water in the drainage water trap 30 may be drawn to cause a lack of such seal water.

Figure 4D:
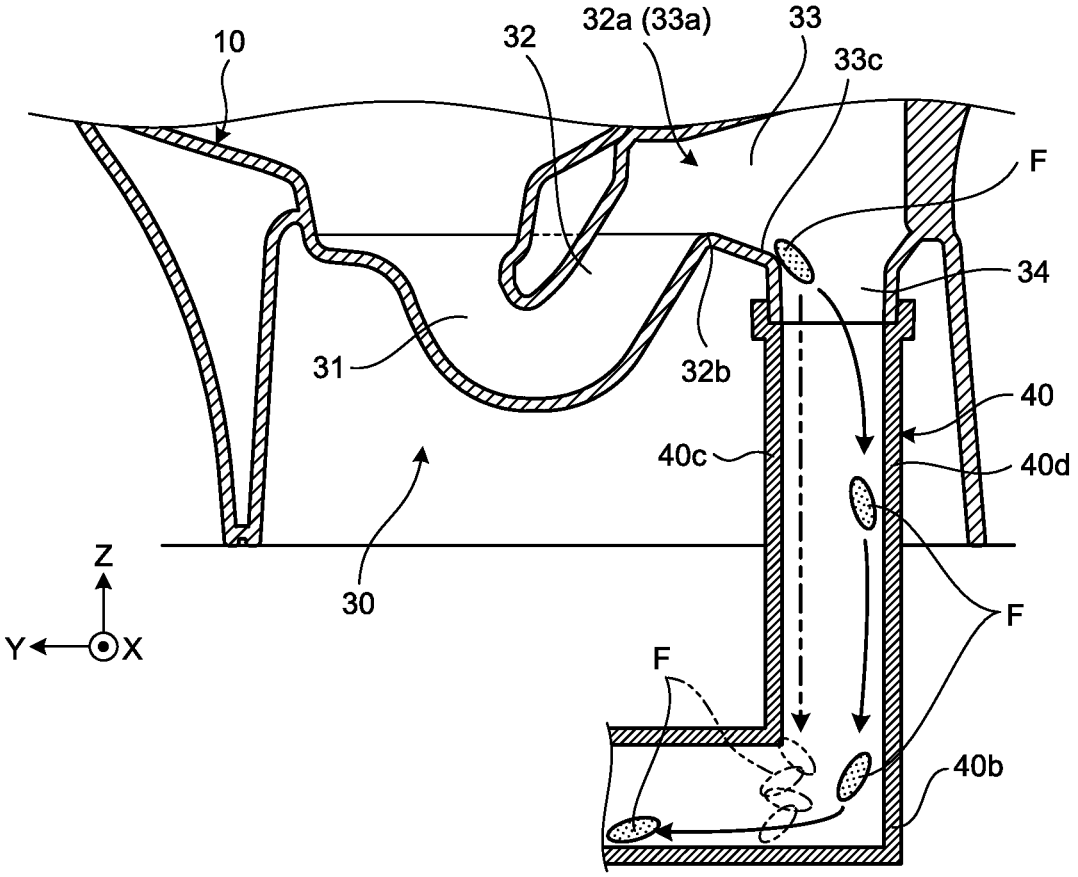
FIG. 4D is an illustration diagram illustrating a state of a drainage water trap at a time of toilet washing.

Hence, in the present embodiment, the contraction flow part 33*d* is formed on the retention surface 33*c*. Accordingly, drainage water that includes waste F is contracted to decrease a flow passage area thereof and increase a flow rate thereof. Thereby, as illustrated in FIG. 4D, drainage water that includes waste F drops while, for example, flowing so as to reach an inner peripheral surface 40*d* on an opposite side of the inner peripheral surface 40*c* of the drainage water pipe 40 on a side of the retention surface 33*c*, or the like, so that a state to seal the drainage water trap 30 such as flowing so as to plug a flow channel or causing a localized accumulation state is not readily caused in the bending part 40*b*. As a result, drainage water that includes waste F smoothly passes through the bending part 40*b* to be discharged. Thus, in the present embodiment, the contraction flow part 33*d* is formed on the retention surface 33*c* so that it is possible to suppress occurrence of sealing in the drainage water pipe 40.

Furthermore, the contraction flow part 33*d* is formed at a center position of the retention surface 33*c* in a width direction thereof, so that it is possible to contract drainage water efficiently and increase a flow rate of such drainage water reliably, and hence, it is possible to further suppress occurrence of sealing in the drainage water pipe 40.

Furthermore, the contraction flow part 33*d* is formed so as to decrease a flow passage area from an upstream side to a downstream side, so that it is possible to increase a flow rate of drainage water W efficiently and gradually, and hence, it is possible to further suppress occurrence of sealing in the drainage water pipe 40.

As described above, the wash-out type toilet 1 according to an embodiment includes the bowl 10 that receives waste and the drainage water trap 30. The drainage water trap 30 includes the inlet 31 that is connected to a lower part of the bowl 10, the rise pipeline 32 that is connected to the inlet 31 and extends upward, the fall pipeline 34 that extends downward toward the drainage water pipe 40 that is arranged on a floor surface, and the intermediate pipeline 33 with the upstream-side portion 33*a* that is connected to the rise pipeline 32 and the downstream-side portion 33*b* that is connected to the fall pipeline 34. Furthermore, the intermediate pipeline 33 is formed so as to slope downward from an upstream side to a downstream side and includes the retention surface 33*c* that temporarily retains waste at a time of toilet washing. Thereby, in the present embodiment, it is possible to improve a waste discharge performance.

First Illustrative Variation

4. Configuration of Retention Surface According to First Illustrative Variation

Figure 5:
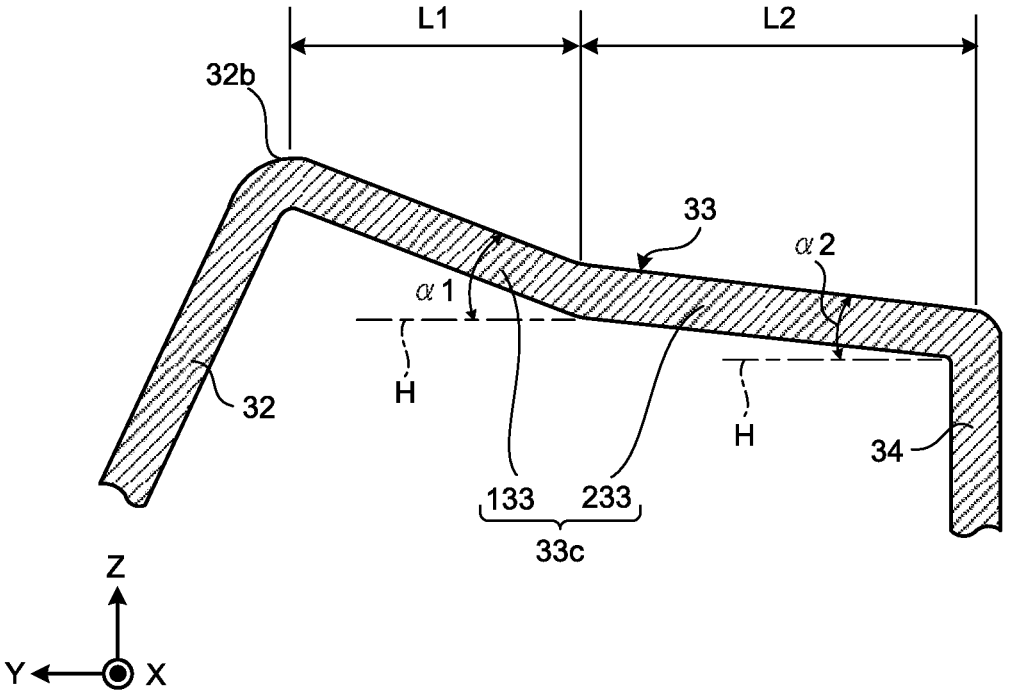
FIG. 5 is an enlarged cross-sectional side view illustrating a retention surface of an intermediate pipeline according to a first illustrative variation.

Next, a first illustrative variation will be described. FIG. 5 is an enlarged cross-sectional side view illustrating a retention surface 33*c* of an intermediate pipeline 33 according the first illustrative variation. Additionally, a configuration common to that of the embodiment as described above will be provided with an identical sign to omit a description(s) thereof below.

As illustrated in FIG. 5, the retention surface 33*c* of the intermediate pipeline 33 according to the first illustrative variation includes a plurality of (herein, two) sloping surfaces with different slope angles. In detail, the retention surface 33*c* includes a first sloping surface 133 and a second sloping surface 233.

The first sloping surface 133 is provided with an upstream side that is connected to the rise pipeline 32 and formed so as to slope, for example, at a first slope angle $\alpha 1$ with respect to a horizontal plane H. The second sloping surface 233 is connected to a downstream side of the first sloping surface 133. Then, the second sloping surface 233 is formed so as to slope at a second slope angle $\alpha 2$ that is smaller than a first slope angle $\alpha 1$ ($\alpha 1 > \alpha 2$).

Furthermore, a downstream side of the second sloping surface 233 is connected to the fall pipeline 34. Therefore, as the first sloping surface 133 is compared with the second sloping surface 233, it is found that the first sloping surface 133 on an upstream side is a steeply sloping surface and the second sloping surface 233 on a downstream side is a gently sloping surface.

Thereby, in the first illustrative variation, it is possible to early put and readily retain waste on the retention surface 33*c* at a time of toilet washing. That is, the first sloping surface 133 is a steeply sloping surface so that waste that passes over the bottom surface 32*b* of the top part 32*a* of the rise pipeline 32 immediately flows into the first sloping surface 133. Thus, it is possible for the first sloping surface 133 to early put waste that passes over the bottom surface 32*b* on the retention surface 33*c*.

Furthermore, a slope of the second sloping surface 233 is gentler than that of the first sloping surface 133, so that, for example, even in a case where waste flows from the first sloping surface 133 at a high speed, it is possible to reduce such a speed on the second sloping surface 233 and it is possible to readily retain waste on the retention surface 33*c*.

Moreover, the second sloping surface 233 is formed in such a manner that a length L2 of the second sloping surface in a flow direction (left and right directions on a plane of paper in FIG. 5) of drainage water is greater than a length L1 of the first sloping surface 133 in such a flow direction (L1<L2).

Thus, the second sloping surface 233 that is a gently sloping surface is configured to be longer than the first sloping surface 133 that is a steeply sloping surface, so that it is possible to retain waste on the second sloping surface 233 of the retention surface 33*c* more readily.

Additionally, although a length L2 of the second sloping surface 233 is greater than a length L1 of the first sloping surface 133, this is illustrative and not limiting, where an identical value may be provided or a length L2 of the second sloping surface 233 may be shorter than a length L1 of the first sloping surface 133. Furthermore, an explanation is provided by using a case of two sloping surfaces with different slope angles in the above description(s), this is not limiting and three or more may be provided.

Second Illustrative Variation

Figure 6:
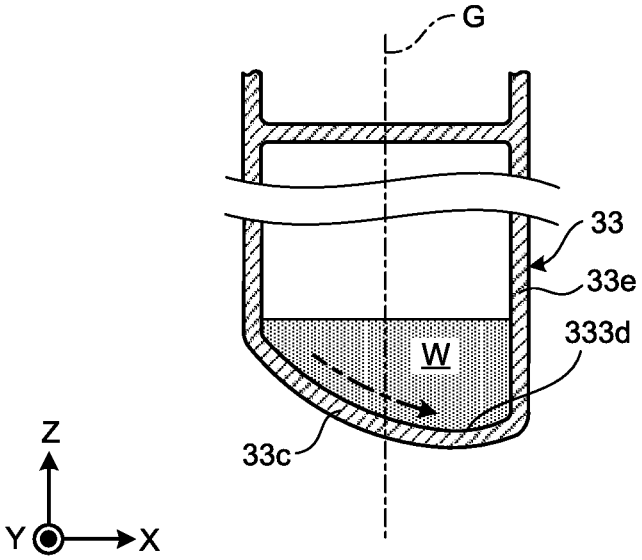
FIG. 6 is a diagram illustrating a cross-sectional shape of an intermediate pipeline according to a second illustrative variation.

5. Configuration of Retention Surface According to Second Illustrative Variation Next, a second illustrative variation will be described. Although the contraction flow part 33*d* in the intermediate pipeline 33 is formed at a center position of the retention surface 33*c* in a width direction thereof in the above description(s), this is not limiting. FIG. 6 is a diagram illustrating a cross-sectional shape of an intermediate pipeline 33 according to the second illustrative variation.

As illustrated in FIG. 6, a contraction flow part 333*d* may be formed so as to be near a side of one side wall 33*e* of a retention surface 33*c* in a width direction thereof (a direction of an X-axis) in the second illustrative variation.

Even in a case where the contraction flow part 333*d* is formed so as to be near one side as described above, it is possible to contract a flow of drainage water W that includes waste as indicated by an arrow of a dashed-dotted line, and hence, it is possible to increase a flow rate of such drainage water W, and as a result, suppress occurrence of sealing in the drainage water pipe 40.

Additionally, although the first rim water guide channel 23*a* and the second rim water guide channel 23*b* are included in the flush toilet 1 according to the embodiment as described above, this is not limiting and only one thereof may be included.

According to an aspect of an embodiment, it is possible to improve a waste discharge performance of a wash-out type toilet.

According to an aspect of an embodiment as described above, a wash-out type toilet according to an embodiment includes a bowl that receives waste and a drainage water trap. The drainage water trap includes an inlet that is connected to a lower part of the bowl, a rise pipeline that is connected to the inlet and extends upward toward its own top part, a fall pipeline that extends downward toward an inlet of a drainage water pipe that is arranged on a floor surface, and an intermediate pipeline with an upstream-side portion that is connected to the rise pipeline and a downstream-side portion that is connected to the fall pipeline. Furthermore, the intermediate pipeline includes a retention surface that is formed to slope downward from an upstream side to a downstream side and temporarily retains waste at a time of toilet washing.

Thereby, it is possible to increase a water level difference at a time of toilet washing even for a comparatively small amount of washing water, and hence, it is possible to improve a waste discharge performance of a flush toilet.

That is, an intermediate pipeline includes a retention surface so that waste is temporarily retained on such a retention surface at a time of toilet washing, and thereby, a lower limit water level of a drainage water trap and a water level of retained water in a bowl are raised by an amount of such waste. Then, as waste that is retained on a retention surface is discharged by washing water, a lower limit water level of a drainage water trap returns to a state before waste is retained. Accordingly, a water level difference at a time of toilet washing is a difference between a raised water level of retained water in a bowl and a returned lower limit water level of a drainage water trap, so that it is possible to attain a temporary increase thereof, and hence, it is possible to improve a waste discharge performance of a flush toilet.

The rise pipeline is formed in such a manner that a radius of curvature of a bottom surface of the top part is greater than that of a bottom surface of the inlet.

Thereby, it is possible for waste to pass over a top part of a rise pipeline smoothly, together with washing water, at a time of toilet washing.

The retention surface includes a contraction flow part that is formed in such a manner that a flow passage area of drainage water is reduced from the upstream side to the downstream side.

Thereby, it is possible to suppress occurrence of sealing in a drainage water pipe. That is, at a time when drainage water that includes waste flows into a drainage water pipe from a retention surface, for example, if dropping straight down is caused, such drainage water that includes waste may flow through such a drainage water pipe so as to plug a flow channel or accumulate in a localized state to be a factor of sealing. On the other hand, a retention surface includes a contraction flow part so that it is possible to increase a flow rate of drainage water, and hence, drainage water that includes waste flows so as to reach a far side of a drainage water pipe without dropping straight down, so that it is possible to suppress occurrence of sealing in such a drainage water pipe.

The contraction flow part is formed at a center position of the retention surface in a width direction thereof.

Thereby, it is possible to contract a flow of drainage water that includes waste efficiently to increase a flow rate of such drainage water reliably, and hence, it is possible to further suppress occurrence of sealing in a drainage water pipe.

The retention surface includes a first sloping surface and a second sloping surface. The first sloping surface slopes at a first slope angle with respect to a horizontal plane. The second sloping surface is connected to a downstream side of the first sloping surface and slopes at a second slope angle smaller than the first slope angle.

Thereby, it is possible to put waste on a first sloping surface early at a time of toilet washing and readily retain it on a second sloping surface.

The second sloping surface is formed in such a manner that a length of the second sloping surface in a flow direction of drainage water is greater than that of the first sloping surface in the flow direction.

Thereby, it is possible to retain waste on a second sloping surface of a retention surface more readily.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A wash-out type toilet, comprising:

a bowl that receives waste; and a drainage water trap that includes:

an inlet that is connected to a lower part of the bowl;

a rise pipeline that is connected to the inlet that is connected to the lower part of the bowl, wherein the rise pipeline extends upward toward a top part of the rise pipeline;

a fall pipeline that extends downward toward an inlet of a drainage water pipe, wherein the drainage water pipe is arranged on a floor surface; and an intermediate pipeline with an upstream-side portion that is connected to the rise pipeline and a downstream-side portion that is connected to the fall pipeline, wherein the intermediate pipeline includes a retention surface that is formed to slope downward from an upstream side to a downstream side and temporarily retains waste at a time of toilet washing, wherein the rise pipeline is formed in such a manner that side surfaces of the top part and side surfaces of the inlet that is connected to the lower part of the bowl are flat and a radius of curvature of a bottom surface of the top part is greater than a radius of curvature of a bottom surface of the inlet.

2. The wash-out type toilet according to claim 1, wherein the retention surface includes a contraction flow part that is formed in such a manner that a flow passage area of drainage water is reduced from the upstream side to the downstream side.

3. The wash-out type toilet according to claim 2, wherein the contraction flow part is formed at a center position of the retention surface in a width direction thereof.

4. The wash-out type toilet according to claim 1, wherein the retention surface includes:

a first sloping surface that slopes at a first slope angle with respect to a horizontal plane; and a second sloping surface that is connected to a downstream side of the first sloping surface and slopes at a second slope angle smaller than the first slope angle.

5. The wash-out type toilet according to claim 4, wherein the second sloping surface is formed in such a manner that a length of the second sloping surface in a flow direction of drainage water is greater than a length of the first sloping surface in the flow direction.

* * * * *